United States Patent [19]

Otsubo

[11] Patent Number: 4,885,439

[45] Date of Patent: Dec. 5, 1989

[54] GAS DAMPED DECELERATION SWITCH

[75] Inventor: Kazumi Otsubo, Saitama, Japan

[73] Assignee: Honda Giken Kogyo Kabushiki Kaisha, Tokyo, Japan

[21] Appl. No.: 239,803

[22] Filed: Sep. 2, 1988

[30] Foreign Application Priority Data

Sep. 4, 1987 [JP] Japan ..... 62-135274[U]

[51] Int. Cl.[4] ..... H01H 35/14

[52] U.S. Cl. ..... 200/61.45 R; 200/61.48; 200/61.53

[58] Field of Search ..... 200/61.45 R, 61.45 M, 200/61.48, 61.51, 61.53; 340/52 R, 52 H, 669, 670, 647; 73/514, 517 R; 307/9, 10 R, 10 SB, 115, 121; 324/62, 415

[56] References Cited

U.S. PATENT DOCUMENTS

| | | | |
|---|---|---|---|
| 4,097,699 | 6/1978 | Larson | 200/61.45 R |
| 4,536,629 | 8/1985 | Diller et al. | 200/61.45 R |
| 4,551,594 | 11/1985 | Katoh | 200/82 R |
| 4,641,041 | 2/1987 | Mattes et al. | 340/52 H X |
| 4,701,628 | 10/1987 | Kumasaka et al. | 340/52 H X |

*Primary Examiner*—J. R. Scott

*Attorney, Agent, or Firm*—Armstrong, Nikaido, Marmelstein, Kubovcik & Murray

[57] ABSTRACT

A deceleration switch for detecting deceleration in excess of a certain magnitude which, for instance, may be indicative of a vehicle crash, comprising: a contact set electrically connected to a pair of output terminals; a mass supported by a spring member and adapted to move from a neutral position to an active position for actuating the contact set under its inertia force when deceleration of a certain magnitude is applied to the switch; and a circuit for monitoring the electric conductivity between two points of the spring member for detecting any break in the spring member. An extra terminal may be provided, in addition to the output terminals, for permitting access to the two points. Alternatively, by connecting a resistor across the contact set, which consists of an normally open contact set, it is possible to detect any fracture in the spring member or in the contact set by monitoring the electric resistance across the output terminals of the deceleration switch. Thus, since the condition of the spring member, which is subjected to vehicle vibrations, can be always monitored, the reliability of the deceleration switch is much improved.

24 Claims, 4 Drawing Sheets

GAS DAMPED DECELERATION SWITCH

TECHNICAL FIELD

The present invention relates to a deceleration switch which can be used for actuating a passive occupant restraint system for a vehicle, and in particular to such a deceleration switch with improved reliability.

BACKGROUND OF THE INVENTION

Various passive occupant restraint systems have been proposed to protect vehicle occupants, in case of a vehicle crash, from secondary impacts resulting from the collision of the occupants with the interior surfaces of the passenger compartment. Such passive occupant restraint systems include various forms of inflatable air bags and seat belt retractor systems which are capable of removing a slack in the seat belt. These passive occupant restraint systems require a sensor for detecting the occurrence of a crash.

Generally, acceleration sensors or deceleration sensors are used for such a purpose, and these sensors are mounted in the parts of the vehicles which are suitable for detecting an acceleration level indicative of a crash substantially without any time delay or which are relatively free from undesirable accidental activation. Accordingly, they may be arranged in the front parts of the vehicles, on the floor tunnels adjacent to the vehicle occupants and other appropriate locations. Therefore, they are often placed in poorly accessible locations. Further, considering the function of such sensors, it is difficult to routinely test the capability of the sensors to operate satisfactorily.

U.S. Pat. No. 4,536,629 discloses a gas damped acceleration switch in which a mass is supported by a spiral spring in such a manner that a contact set is closed only after the mass has traveled a certain distance against the spring by an inertia force acting on it. Further, damping means is provided to the mass so that the acceleration switch be insensitive to shocks of short durations and small magnitudes, and be prevented from actuating the passive occupant restraint system in conditions other than crash situations.

In such an acceleration switch, it is extremely important to assure the spring member for supporting the sensor mass to be in working order at all time. For instance, if there is any fracture or any other damage in the spring member, the threshold level of acceleration becomes inappropriate, and the acceleration switch becomes totally incapable of detecting such acceleration with any accuracy. This is significant all the more because it cannot be discovered unless a thorough testing of the acceleration switch is performed.

BRIEF SUMMARY OF THE INVENTION

In view of such problems of the prior art, a primary object of the present invention is to provide a deceleration switch which is made reliable through provision of means for detecting the presence of any fracture in the spring member which elastically support the sensor mass of the deceleration switch.

A second object of the present invention is to provide a deceleration switch which is provided with means for detecting any fracture in its spring member as soon as such a fracture is produced.

These and other objects of the present invention can be accomplished by providing a deceleration switch for detecting deceleration of a certain magnitude, comprising: contact means which are electrically connected to a pair of output terminals of the deceleration switch; a mass supported by a spring member and adapted to move from a neutral position to an active position for actuating the contact means under its inertia force when deceleration of a certain magnitude is applied to the deceleration switch; and means for monitoring the electric conductivity of a part of the spring member.

Thus, the condition of the spring member can be watched all the time. This is particularly significant because the sensor mass repeatedly deflects the spring member, even when the deceleration level is not quite high enough to activate the deceleration switch, by being subjected to vehicle vibrations, thus placing the spring member under a severe stress condition, and because such sensors are often placed in a poorly accessible part of a vehicle and are therefore unsuitable for regular inspection.

According to a preferred embodiment of the present invention, the spring member consists of a spiral sheet spring having a plurality of spiral arms each of which extends from a common central part to its peripheral part, the central part being provided with a part of the contact means; and the electric conductivity monitoring means comprises leads connected to the peripheral parts of the different spiral arms of the spiral sheet spring, and electric current monitoring means which is connected to the leads and monitors electric resistance between the two leads. The locations of these leads may be selected so that any possible fracture in the spring member may be detected as a change in the electric resistance between the two leads. Preferably, at least one of the leads consists of one of the output terminals of the deceleration switch. This is accomplished in the case where the spring member provides a part of the electric circuitry of the deceleration switch.

According to a certain aspect of the present invention, the contact means consists of a normally open contact set which consists of a moveable contact attached to the spring member and a fixed contact attached to a fixed part of the deceleration switch, and closes when actuated by the mass; and the electric conductivity monitoring means comprises a resistor connected across the normally open contact set, and electric current monitoring means connected between a part of the spring member and the fixed contact. Thus, the electric current monitoring means can check not only the spring member but also the contact set and the related parts with the same circuitry. According to a preferred embodiment of the present invention, one of the output terminal is connected to a part of the spring member while the other output terminal is connected to the fixed contact, and the electric current monitoring means is connected across the output terminals.

According to a particularly advantageous embodiment of the present invention, the spring member consists of a spiral sheet spring having a pair of arms which extends from its central part to its periphery, and the peripheral end of one of the arms is connected to one of the output terminals while the peripheral end of the other arm is connected to an end of the resistor whose other end is connected to the fixed terminal. Thus, there is no need to provide anY extra terminals other than the normal output terminals for monitoring the electric conductivity of the spring member.

BRIEF DESCRIPTION OF THE DRAWINGS

Now the present invention is described in the following in terms of specific embodiments with reference to the appended drawings, in which.

DETAILED DESCRIPTION OF THE PREFERRED EMBODIMENTS

Figure 1:
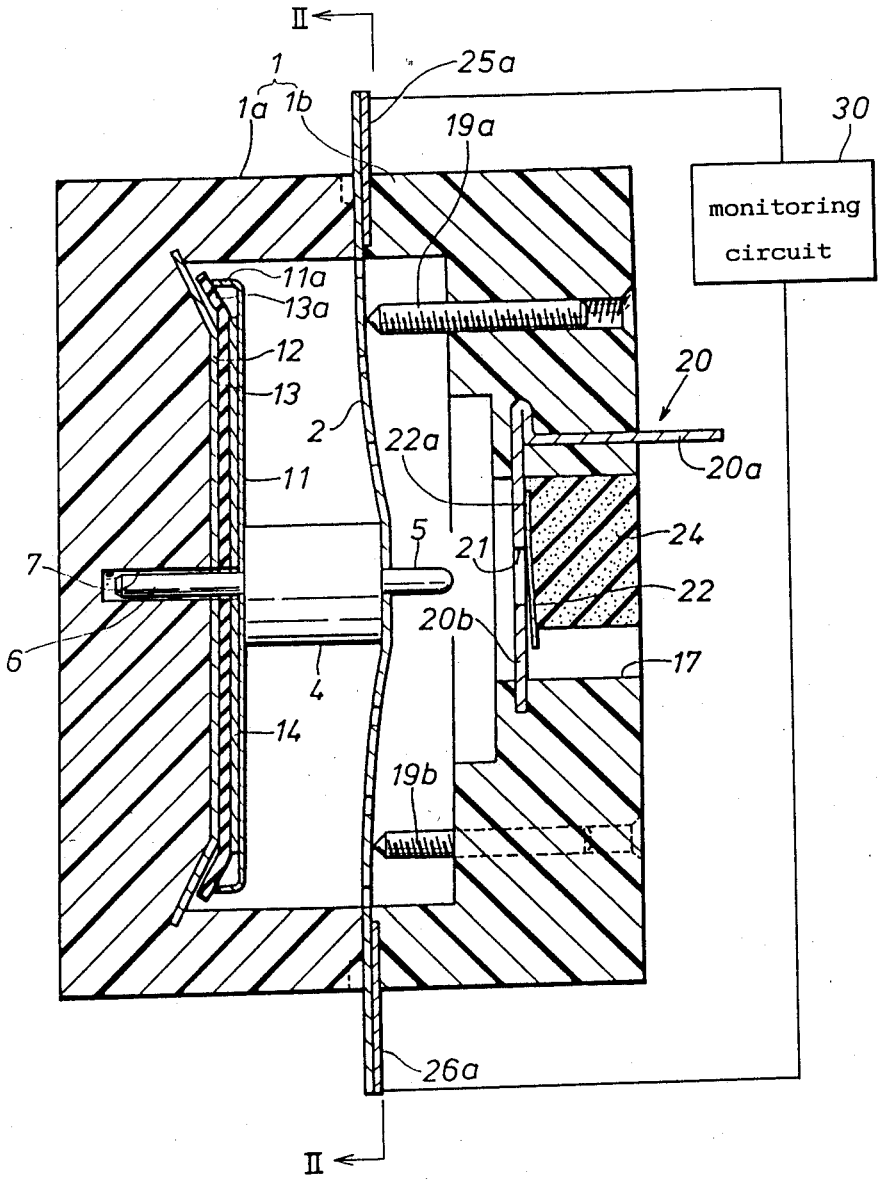
FIG. 1 is a sectional view of an embodiment of the deceleration switch according to the present invention.
Figure 2:
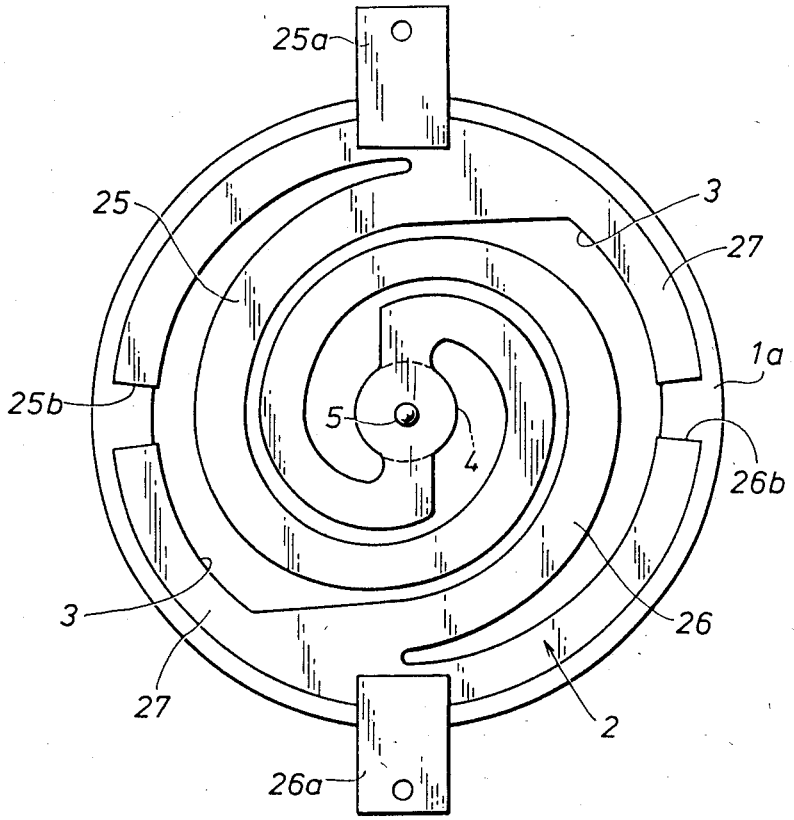
FIG. 2 is a sectional view taken along line II—II of FIG. 1.

FIGS. 1 and 2 show the first embodiment of the deceleration switch according to the present invention. The casing 1 of this deceleration switch consists of a rear half 1*a* and a front half 1*b*, each consisting of a generally cylindrical cup-shaped member which is injection molded from a plastic material. These two halves 1*a* and 1*b* are integrally joined together at their rims with a spiral sheet spring 2 interposed therebetween.

As best shown in FIG. 2, the spiral sheet spring 2 is made from a circular sheet of phosphor bronze by cutting out a pair of spiral notches 3 extending from the center towards the periphery. A cylindrical sensor mass 4 is attached to the center, of the rear surface of the spiral sheet spring 2 by brazing. The front end of the sensor mass 4 is provided with a pin 5 which is passed through the center of the spiral sheet spring 2. The rear end of the sensor mass 4 is attached to a disk 11, made of circular sheet metal, by brazing, and is provided with a rod 6 which is passed through the disk 11 and received in a guide hole 7 provided in the bottom wall of the rear half 1*a* of the casing 1. The outer periphery of the disk 11 is provided with an axial flange 11*a* directed towards the bottom surface of the rear half 1*a* of the casing 1.

The bottom surface of the rear half 1*a* is slightly depressed along its outer periphery and is generally covered by a back up plate 12 which is integrally insert molded with the rear half 1*a* of the casing 1. A relatively rigid retainer plate 14 is attached to the back up plate 12 at their centers, for instance by spot welding, with a flexible suction sheet 13 interposed therebetween. This suction sheet 13 is made of a soft material, such as synthetic rubber, and its outer periphery 13*a* protrudes from the outer periphery of the retainer plate 14. As best shown in FIG. 1, the diameter of the axial flange 11*a* of the disk 11 is larger than the outer diameter of the retainer plate 14 but is smaller than the outer diameter of the suction sheet 13.

Thus, the sensor mass 4 is allowed to undergo an axial motion only, by means of the rod 6 the guide hole 7, and is elastically supported by the spiral sheet spring 2. Further, the motion of the sensor mass 4 is damped by the vacuum suction created between the disk 11 and the suction sheet 13, as well as by the fluid resistance resulting from the motion of the disk 11 inside the cylindrical chamber defined in the casing 1.

A part of the outer periphery of the spiral sheet spring 2 is provided with a pair of terminal pieces 25*a* and 26*a* which protrude outwardly from the casing 1 at diametrically opposed positions. A pair of set screws 19*a* and 19*b* are threaded axially through the bottom wall of the front half 1*b* of the casing 1 at symmetric positions and the free ends of these set screws 19*a* and While the invention has been particularly shown and described in reference to preferred embodiments thereof, it will be understood by those skilled in the art that changes in form and details may be made without departing from the spirit and scope of the invention. 19*b* abut parts of the spiral sheet spring 2. Thus, by adjusting these set screws 19*a* and 19*b*, the preloading of the spiral sheet spring 2 can be adjusted.

The central part of the bottom wall of the front half 1*b* of the casing 1 is provided with a bore 17. An L-shaped terminal piece 20 is insert molded in the bottom wall of the front half 1*b*, and its one end 20*a* protrudes axially and outwardly from the bottom wall while its other end 20*o* extends across the bore 17. A middle part of the other end 20*b* is provided with a hole 21 for inserting the pin 5 therethrough, and a spring leaf 22 is attached to the rear surface of the terminal piece 20 at its one end 22*a* for elastically contacting the free end of the pin 5 when it has passed through the hole 21 under its inertia force in the case of a crash.

The bore 17 is generally filled with soft foam rubber 24 to give some damping to the motion of the spring leaf 22 when the pin 5 of the sensor mass 4 runs into the spring leaf 22.

As best shown in FIG. 2, the spiral sheet spring 2 is provided with a pair of spiral arms 25 and 26 extending spirally from the center to the periphery, and an annular peripheral portion 27, defined by the spiral cut-outs 3. The annular peripheral portion 27 is cut through at a pair of locations (as denoted by numerals 25*b* and 26*b*) which are angularly displaced from the terminals 25*a* and 26*a* by 90 degrees. Therefore, the two terminal pieces 25*a* and 26*a* are electrically connected to each other solely by way of the two arms 25 and 26 of the spiral sheet spring 2 which are arranged in series with the annular peripheral portion 27 being separated at the locations 25*b* and 26*b*.

A monitoring circuit 30 is connected across the terminal pieces 25*a* and 25*b* and supplies a flow of small electric current at all time or, alternatively, at selected time points, and measures the value of the electric current so as to test the electric conductivity of the spiral arms 25 and 26 from the terminal pieces 25*a* and 26*a*. Therefore, according to this embodiment, if there is any fracture, it is electrically detected by the monitoring circuit 30 and is notified to the operator of the vehicle by appropriate means which is not shown in the drawings. This fracture may be either complete by extending across a part of the arms 25 and 26 or partial by not extending completely across a part of the arms 25 and 26. In the former case, the electric resistance between the two terminal pieces 25*a* and 26*a* becomes infinitely great. In the latter case, it is detected as a corresponding change in the electric resistance between the terminal pieces 25*a* and 26*a*.

Now the action of this embodiment is described in the following:

Normally, the sensor mass 4 is elastically supported by the spiral sheet spring 2, and the disk 11 is in close contact with the retainer plate 14 with the axial flange 11*a* of the disk 11 touching the periphery 13*a* of the suction sheet 13.

When a deceleration is applied to the sensor mass 4, the sensor mass 4 is urged toward the front half 1*b* of the casing 1 under its own inertia force. Thus, the sensor mass 4 is thrust forward, but encounters two opposing forces; one of the opposing forces is the elastic force from the spiral sheet spring 2 which may be preloaded as desired while the other opposing force arises from the vacuum which is generated in the space defined by the disk 11, the outer periphery 13*a* of the suction sheet 13 and the retainer plate 14. Thus, the sensor mass 4 can move forward until the pin 5 comes into contact with the spring leaf 22 only when the inertia force of the sensor mass 4 can overcome these two opposing forces, or when the deceleration level is indicative of an actual vehicle crash. When the pin 5 is brought into contact with the spring leaf 22, a highly conductive electric path is formed between the terminal pieces 20 and 25*a* and between the terminal pieces 20 and 26*a*, and an appropriate passive occupant restraint system is thereby actuated.

The circuit to be activated by this deceleration switch may thus be connected across the terminal pieces 20 and 25*a* or across the terminal pieces 20 and 26*a*. Optionally, two detection circuits may be connected across the terminal pieces 20 and 25*a* and across the terminal pieces 20 and 26*a*, respectively, with an OR circuit connected between the outputs of these detection circuits and the circuit which is to be activated. In this case, even in case of a complete fracture of one of the arms 25 and 26 of the spiral sheet spring 2, the deceleration switch is capable of operating to a certain extent even though the threshold level of deceleration may not be accurate depending on the extent of the fracture.

Figure 3:
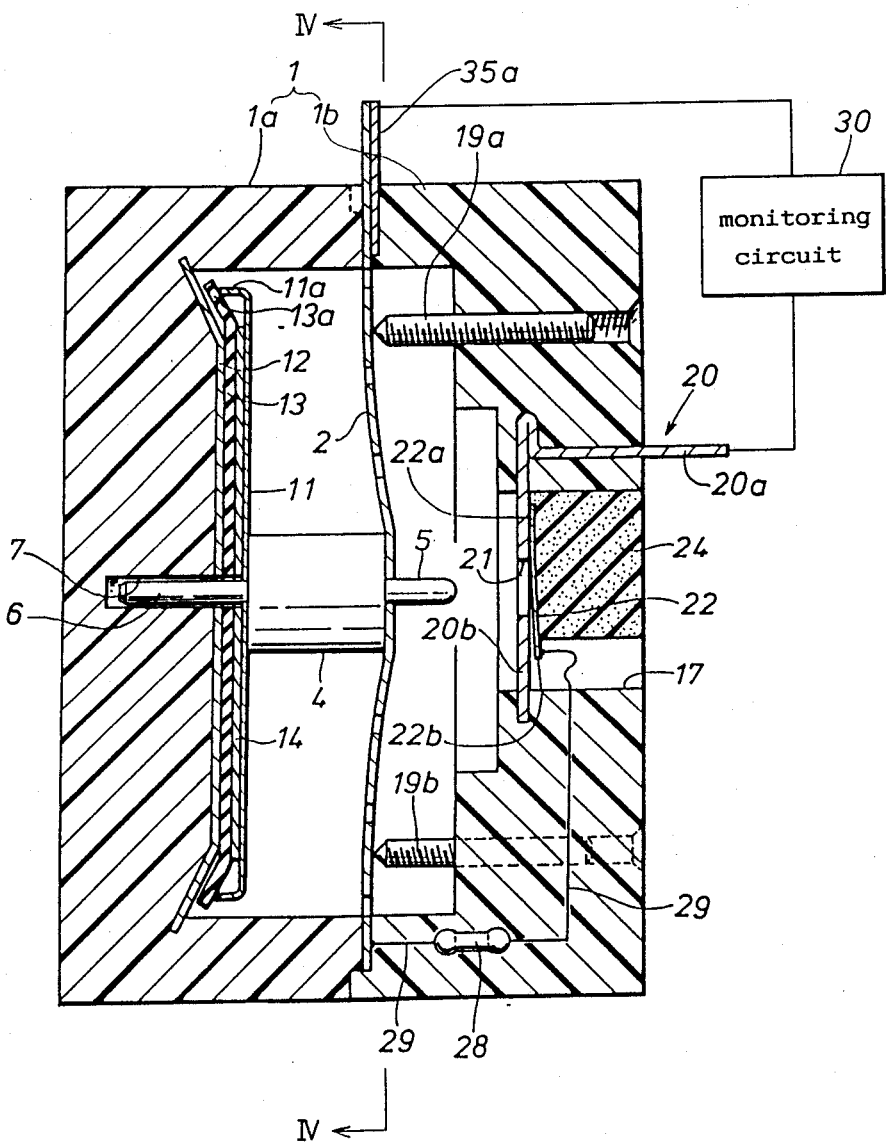
FIG. 3 is a view similar to FIG. 1 showing a second embodiment of the present invention.
Figure 4:
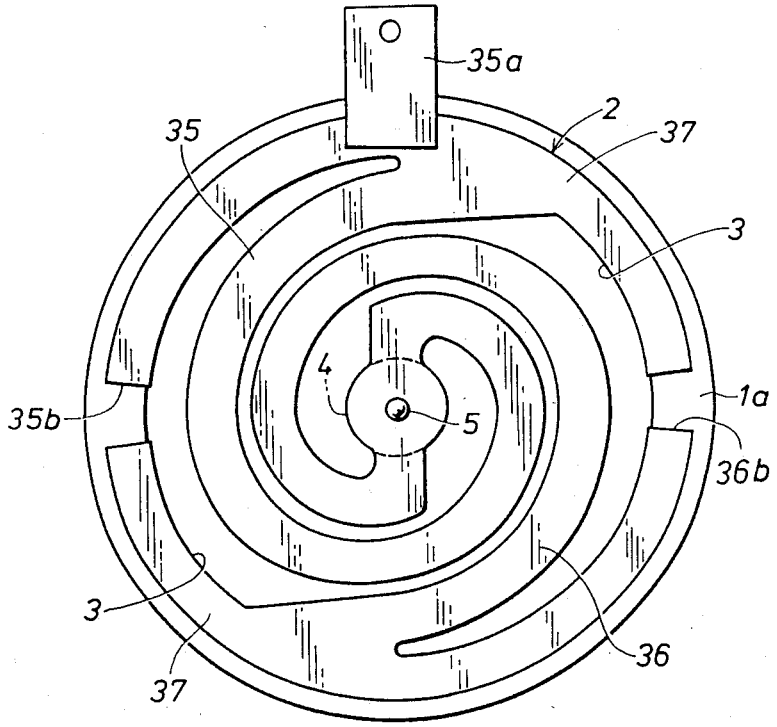
FIG. 4 is a sectional view taken along line IV—IV of FIG. 3.

FIGS. 3 and 4 show another embodiment of the present invention. In this embodiment, the parts corresponding to those of the preceding embodiment are denoted with like numerals.

In this embodiment, the spiral sheet spring 2 is provided with a pair of arms 35 and 36 extending spirally from the center to the periphery, and an annular peripheral portion 37, defined by the spiral cut-outs 3. So far, this embodiment is not different from the preceding embodiment, but the spiral sheet spring 2 of this embodiment is provided with only one terminal piece 35*a* which protrudes outwardly from a part of the peripheral portion 37 of the spiral sheet spring 2. Further, the annular peripheral portion 37 is cut through at a pair of locations (as denoted by numerals 35*b* and 36*b*) which are angularly displaced from the terminal 35*a* by 90 degrees on either side.

A resistor 28 is encapsulated in the bottom wall of the front half 1*b* of the casing 1, and is connected to the part of the spiral sheet spring 2 which is diametrically opposed to the terminal piece 35*a* at its one end and to the free end 22*b* of the spring leaf 22 at its other end by wire leads 29. Thus, a continuous electric path is formed through the outer end 20*a* of the terminal piece 20, the spring leaf 22, the resistor 28, the two arms 35 and 36 of the sheet spring 2 and the terminal piece 35*a*. Thus, according to this embodiment, by conducting electric current of a small amplitude through this continuous electric path and monitoring the flow of the electric current with a monitoring circuit 30, it is possible to detect any break in this otherwise continuous path. Thus, according to this embodiment, any fracture not only in the two arms 35 and 36 of the spiral sheet spring 2 but also in the spring leaf 22 and other parts in this continuous path (for instance, any fatigue break in the electrodes which are subjected to vibrations, any failure in the soldered parts of the terminal pieces and so on) can be detected.

What we claim is:

1. A deceleration switch for detecting deceleration of a certain magnitude, comprising:

contact means including a spring member for activating the deceleration switch, said contact means being electrically connected to a pair of output terminals of said deceleration switch;

a mass supported by said spring member and adapted to move from a neutral position to an active position for actuating said contact means under its inertia force when deceleration of a certain magnitide is applied to said deceleration switch; and means for monitoring the electric conductivity of a part of said spring member.

2. A deceleration switch as defined in claim 1, wherein said spring member consists of a spiral sheet spring having a plurality of spiral arms each of which extends from a common central part to its peripheral part, said central part being provided with a part of said contact means; and said electric conductivity monitoring means comprises leads connected to said peripheral parts of the different spiral arms of said spiral sheet spring, and electric current monitoring means which is connected to said leads and monitors electric resistance between said two leads.

3. A deceleration switch as defined in claim 2, wherein at least one of said leads consists of one of said output terminals of said deceleration switch.

4. A deceleration switch as defined in claim 1, wherein said contact means consists of a normally open contact set which consists of a moveable contact attached to said spring member and a fixed contact attached to a fixed part of said deceleration switch, and closes when actuated by said mass; and said electric conductivity monitoring means comprises a resistor connected across said normally open contact set, and electric current monitoring means connected between a part of said spring member and said fixed contact.

5. A deceleration switch as defined in claim 4, wherein one of said output terminals is connected to a part of said spring member while the other output terminal is connected to said fixed contact, and said electric current monitoring means is connected across said output terminals.

6. A deceleration switch as defined in claim 5, wherein said spring member consists of a spiral sheet spring having a pair of spiral arms which extends from its central part to its periphery, and the peripheral end of one of said arms is connected to one of said output terminals while the peripheral end of the other arm is connected to an end of said resistor whose other end is connected to said fixed terminal.

7. A deceleration switch for detecting deceleration of a predetermined magnitude, comprising:

a casing;

a pair of electrodes extending through and supported by said casing, and having internal ends and external ends;

a spiral electrically conductive spring supported within said casing, said spiral spring having a pair of spiral arms extending spirally from the center to annular peripheral portions located at the periphery of said spiral spring with each spiral arm being electrically connected to the internal end of one of said electrodes, said annular peripheral portions being discontinuous so as to only allow electrical current to flow between said electrodes through said spiral arms;

a mass movably disposed within said casing and operatively connected to said spiral spring;

a contact disposed within said casing and electrically connected to an external electrode, said contact operatively interacting with said movable mass to form an electrical connection between said contact and said spiral spring resulting in a connection between said external electrode and one of said pair of electrodes to activate the switch; and monitoring means for continuously monitoring the electrical conductivity through said spiral arms.

8. A deceleration switch according to claim 7, wherein said monitoring means includes a monitoring circuit electrically interconnected between the external ends of said electrodes.

9. A deceleration switch according to claim 8, including a damper operatively connected to said movable means.

10. A deceleration switch according to claim 8, wherein said spiral spring is made from a circular sheet of phosphor bronze.

11. A deceleration switch according to claim 9, wherein said spiral spring is made from a circular sheet of phosphor bronze.

12. A deceleration switch according to claim 7, wherein said external electrode is one of said pair of electrodes with an electrical resistor electrically interconnecting said external electrode and said spiral spring, and said monitoring means includes a monitoring circuit electrically interconnected between said external electrode and the other electrode of said pair of electrodes.

13. A deceleration switch according to claim 10, including a damper operatively connected to said movable mass.

14. A deceleration switch according to claim 12, including a damper operatively connected to said movable mass.

15. A deceleration switch for detecting deceleration of a predetermined magnitude, comprising:

a casing;

a pair of electrodes extending into and supported by said casing;

an electrically conductive spring disposed within said casing;

a mass movably disposed within said casing, and operatively connected to said spring;

a contact operatively interacting with said movable mass for closing a circuit between said electrodes to activate the switch due to an inertia force exceeding the predetermined magnitude acting on said movable mass; and monitor means for monitoring the electrical integrity of said spring.

16. A deceleration switch according to claim 15, wherein said monitoring means includes a monitoring circuit extending through at least a portion of said spring to monitor the electrical integrity of said spring.

17. A deceleration switch according to claim 16, wherein internal ends of said electrodes are electrically connected at separate positions on said spring to monitor a section of spring between the connections, and said monitoring circuit electrically interconnects said electrodes.

18. A deceleration switch according to claim 16, wherein one of said electrodes is defined by an external electrode electrically connected to said contact with said contact being electrically connected to said spring, and said monitoring circuit monitors the electrical conductivity between the electrodes through the switch.

19. A deceleration switch according to claim 18, wherein an electrical resistor electrically interconnects said external electrode and said spring.

20. A deceleration switch according to claim 15, wherein said spring is defined by a spiral spring having a pair of spiral arms extending spirally from the center to annular peripheral portions located at the periphery of said spring with each spiral arm being electrically connected to an internal end of one of said electrodes, said annular peripheral portions being discontinuous so as to only allow electrical current to flow through said spiral arms.

21. A deceleration switch according to claim 16, wherein said spring is defined by a spiral spring having a pair of spiral arms extending spirally from the center to annular peripheral portions located at the periphery of said spring with each spiral arm being electrically connected to an internal end of one of said electrodes, said annular peripheral portions being discontinuous so as to only allow electrical current to flow through said spiral arms.

22. A deceleration switch according to claim 17, wherein said spring is defined by a spiral spring having a pair of spiral arms extending spirally from the center to annular peripheral portions located at the periphery of said spring with each spiral arm being electrically connected to an internal end of one of said electrodes, said annular peripheral portions being discontinuous so as to only allow electrical current to flow through said spiral arms.

23. A deceleration switch according to claim 18, wherein said spring is defined by a spiral spring having a pair of spiral arms extending spirally from the center to annular peripheral portions located at the periphery of said spring with each spiral arm being electrically connected to an internal end of said electrodes, said annular peripheral portions being discontinuous so as to only allow electrical current to flow through said spiral arms.

24. A deceleration switch according to claim 19, wherein said spring is defined by a spiral spring having a pair of spiral arms extending spirally from the center to annular peripheral portions located at the periphery of said spring with each spiral arm being electrically connected to an internal end of one of said electrodes, said annular peripheral portions being discontinuous so as to only allow electrical current to flow through said spiral.

* * * * *